US011198992B2

(12) United States Patent
Marty et al.

(10) Patent No.: US 11,198,992 B2
(45) Date of Patent: Dec. 14, 2021

(54) DRAIN ASSEMBLY AND FAUCET LIFT ROD COUPLING DEVICE

(71) Applicant: Delta Faucet Company, Indianapolis, IN (US)

(72) Inventors: Garry Robin Marty, Fishers, IN (US); Brian Alan Enlow, Noblesville, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 16/887,631

(22) Filed: May 29, 2020

(65) Prior Publication Data

US 2020/0399878 A1 Dec. 24, 2020

Related U.S. Application Data

(60) Provisional application No. 62/862,792, filed on Jun. 18, 2019.

(51) Int. Cl.
*E03C 1/23* (2006.01)

(52) U.S. Cl.
CPC ..... *E03C 1/2302* (2013.01)

(58) Field of Classification Search
CPC ... E03C 1/22; E03C 1/23; E03C 1/232; E03C 1/2302; E03C 1/2304; E03C 1/26; E03C 1/262; E03C 1/264; E03C 1/28; E03C 1/282
See application file for complete search history.

(56) References Cited

U.S. PATENT DOCUMENTS

| | | | | |
|---|---|---|---|---|
| 3,419,919 | A * | 1/1969 | Stayner | E03C 1/23 4/692 |
| 4,218,785 | A * | 8/1980 | Crawford | E03C 1/232 4/295 |
| 5,050,247 | A | 9/1991 | Hsu | |
| 8,407,829 | B2 | 4/2013 | Vogel | |
| 8,739,328 | B2 * | 6/2014 | Duncan | E03C 1/2302 4/684 |
| 10,221,549 | B1 * | 3/2019 | Fregoe | E03C 1/2302 |
| 2002/0120984 | A1 | 9/2002 | Gray et al. | |
| 2010/0050337 | A1 | 3/2010 | Li et al. | |
| 2014/0310864 | A1 | 10/2014 | Ye et al. | |
| 2016/0251838 | A1 | 9/2016 | Cringle | |
| 2017/0183851 | A1 | 6/2017 | Lin et al. | |
| 2018/0171610 | A1 * | 6/2018 | Ahuja | E03C 1/2302 |

FOREIGN PATENT DOCUMENTS

| | | |
|---|---|---|
| CA | 2642377 | 5/2009 |
| CA | 2644217 | 5/2009 |
| CA | 2639132 | 2/2010 |
| CA | 2916332 | 6/2017 |
| CN | 106499019 | 3/2017 |
| IL | 59796 | 12/1984 |

* cited by examiner

*Primary Examiner* — Janie M Loeppke
(74) *Attorney, Agent, or Firm* — Bose McKinney & Evans LLP

(57) ABSTRACT

A drain assembly for a faucet includes a lift rod configured to be carried by the faucet and actuated relative to the faucet. A lever arm is configured to actuate a drain plug. A coupling device includes a first coupling portion coupled to the lift rod, a second coupling portion coupled to the lever arm, and a living hinge coupling the first coupling portion to the second coupling portion. The living hinge facilitates actuation of the lever arm and the drain plug upon actuation of the lift rod.

19 Claims, 5 Drawing Sheets

DRAIN ASSEMBLY AND FAUCET LIFT ROD COUPLING DEVICE

CROSS-REFERENCE TO RELATED APPLICATION

The present application claims priority to U.S. Provisional Patent Application Ser. No. 62/862,792, filed Jun. 18, 2019, the disclosure of which is expressly incorporated herein by reference.

BACKGROUND AND SUMMARY OF THE DISCLOSURE

The present invention relates generally to faucets and, more particularly, to a drain assembly for use with a faucet including a lift rod coupling.

Conventional lavatory faucets are often coupled to a pop-up drain assembly. Such drain assemblies typically include a pull or lift rod extending in a generally vertical direction from below the sink deck upwardly to a position above the faucet. A lower end of the lift rod is usually coupled to a lever arm wherein raising and lowering of the lift rod by a user from above the sink deck causes corresponding pivoting movement of the lever arm to raise and lower a drain plug positioned within the sink basin.

Conventional faucets and drain assemblies typically require the installer to connect most of the components from below the sink deck in often cramped and dimly lit work areas. More particularly, the installer typically has the awkward task of attaching the lever arm to the lift rod. The installer often must reach up high under the sink deck with a wrench to install and to adjust the lever arm of the drain assembly to the lift rod.

In an illustrative embodiment of the present disclosure, a drain assembly for a faucet includes a lift rod configured to be carried by the faucet and actuated relative to the faucet. A lever arm is configured to actuate a drain plug. A coupling device includes a first coupling portion coupled to the lift rod, a second coupling portion coupled to the lever arm, and a living hinge coupling the first coupling portion to the second coupling portion. The living hinge facilitates actuation of the lever arm and the drain plug upon actuation of the lift rod.

According to another illustrative embodiment of the present disclosure, a drain assembly for a faucet includes a lift rod configured to be carried by the faucet and actuated relative to the faucet. A lever arm is configured to actuate a drain plug. A coupling device includes a first coupling portion coupled to the lift rod, and the first coupling portion includes a collet and a lift rod. The collet is disposed about the lift rod, and the collet includes a concave tapering surface and a first threaded surface. A retainer includes a conical portion receiving the lift rod and including a convex tapering surface, the retainer further includes a second threaded surface. The second threaded surface is engagable with the first threaded surface of the collet to cause the convex tapering surface to engage the concave tapering surface of the collet to urge the conical portion to engage the lift rod and thereby secure the retainer to the lift rod. The coupling device further includes a second coupling portion coupled to the lever arm. The coupling device also includes a leg portion coupling the first coupling portion to the second coupling portion and facilitating actuation of the lever arm and the drain plug upon actuation of the lift rod.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the disclosure described herein are not intended to be exhaustive or to limit the disclosure to the precise forms disclosed. Rather, the embodiments described herein enable one skilled in the art to practice the disclosure.

Figure 1:
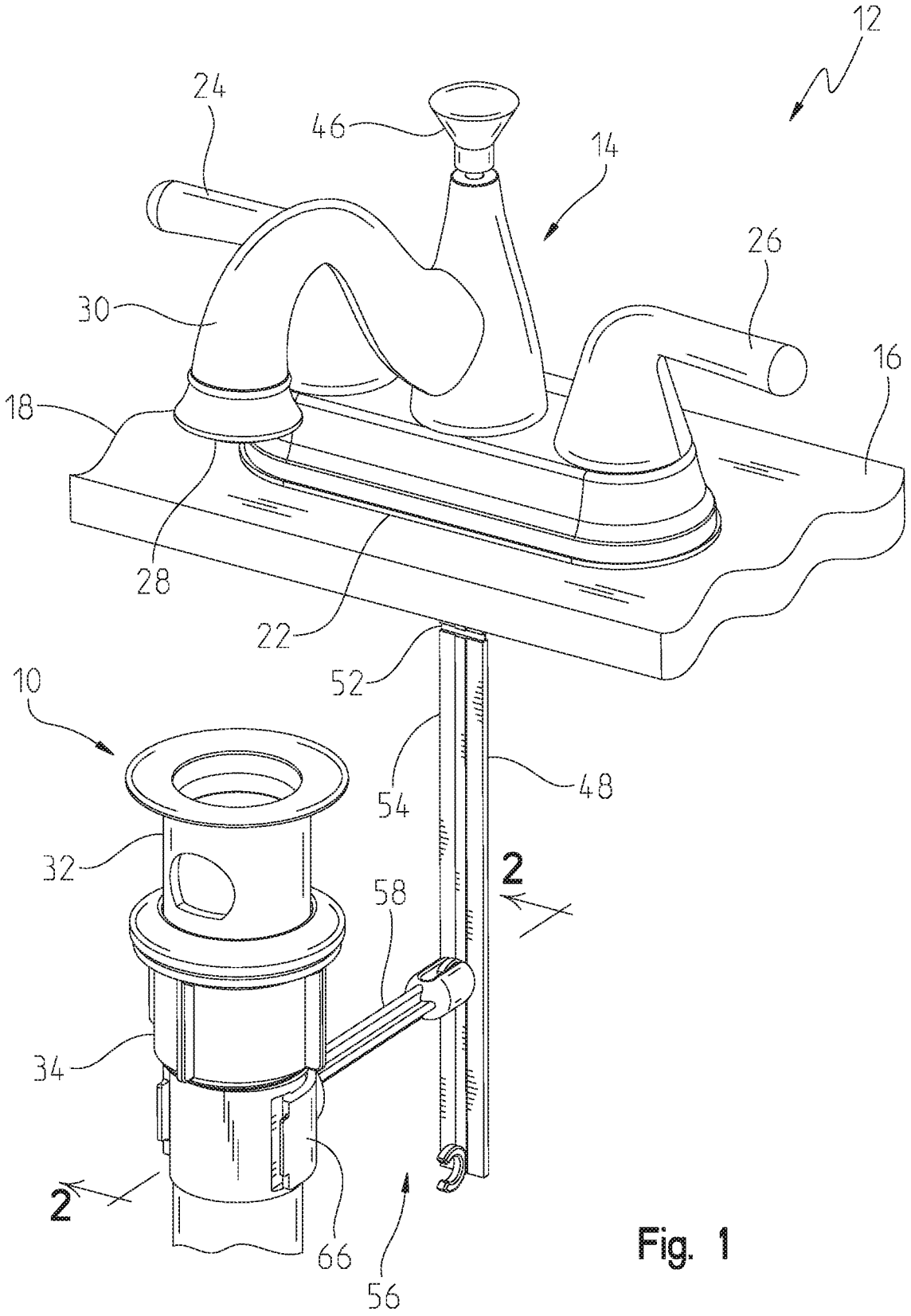
FIG. 1 is a top perspective view of an illustrative embodiment of a faucet and a drain assembly; a sink basin and a drain plug of the drain assembly are omitted for clarity.
Figure 2A:
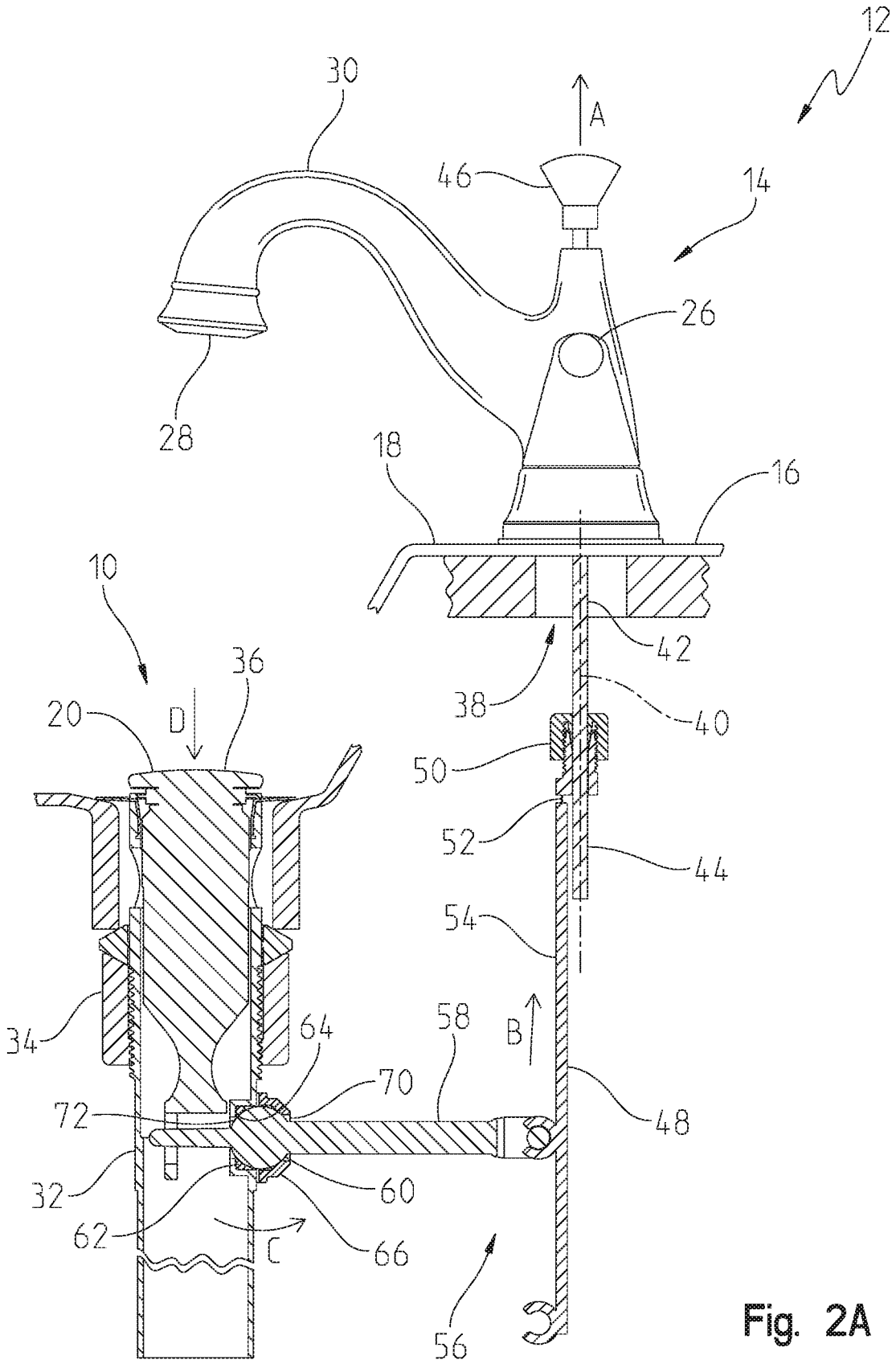
FIG. 2A is a side elevation view, in partial section, of the faucet and drain assembly of FIG. 1.

Referring initially to FIGS. 1 and 2A, an illustrative embodiment of a drain assembly 10 for use with a faucet 12 is shown as including an upper faucet assembly 14 positioned above a mounting base 16, illustratively a sink deck 18 supporting a sink basin 20. The upper faucet assembly 14 illustratively includes an escutcheon 22. Hot and cold water handles 24, 26 and are positioned above the escutcheon 22 and are operably coupled to hot and cold water control valves (not shown). As is known in the art, rotating the hot and cold water handles 24, 26 adjusts the hot and cold water control valves to control the flow of water delivered to the outlet 28 of a delivery spout 30. Opposite the upper faucet assembly 14, the drain assembly 10 includes a drain body 32 that is illustratively secured to the sink basin 20 via a retainer nut 34. The drain body 32 movably carries a drain plug 36. More specifically, the drain plug 36 is movable, or actuatable, relative to the drain body 32 from a closed or sealing position (see FIG. 2) to an open position (not shown) and vice versa. In the closed position, the drain plug 36 inhibits water in the sink basin 20 from entering the drain body 32. In the open position, the drain plug 36 permits water in the sink basin 20 to enter and flow through the drain body 32.

As shown specifically in FIG. 2A, the upper faucet assembly 14 defines a lift rod passageway 38 having a longitudinal axis 40. A lift rod 42 is illustratively supported for sliding movement within the lift rod passageway 38 and generally along the longitudinal axis 40. The lift rod 42 includes a shaft 44 supporting a handle 46 disposed above the upper faucet assembly 14. Below the upper faucet assembly 14 and opposite the handle 46, the shaft 44 may have any of various lengths and couples to a coupling device 48. Generally, the coupling device 48 includes a first coupling portion 50 coupled to the shaft 44 of the lift rod 42, a living hinge 52 coupled to the first coupling portion 50, a leg portion 54 coupled to the living hinge 52, and a second coupling portion 56 coupled to the leg portion 54. These features of the coupling device 48 are described in further detail below.

Figure 2B:
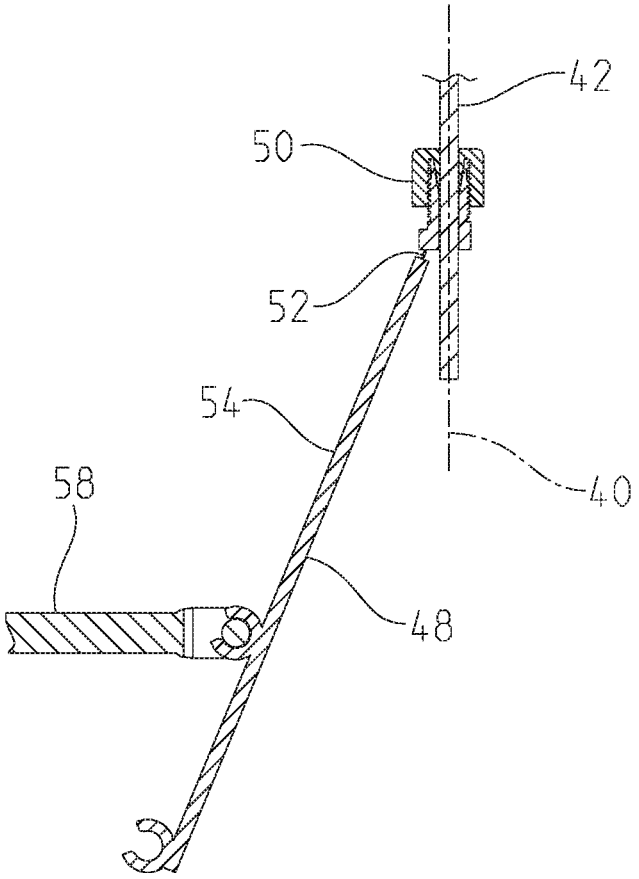
FIG. 2B is a partial side elevation view, in section, of the drain assembly of FIG. 1 spaced apart from a faucet by a different distance.
Figure 3:
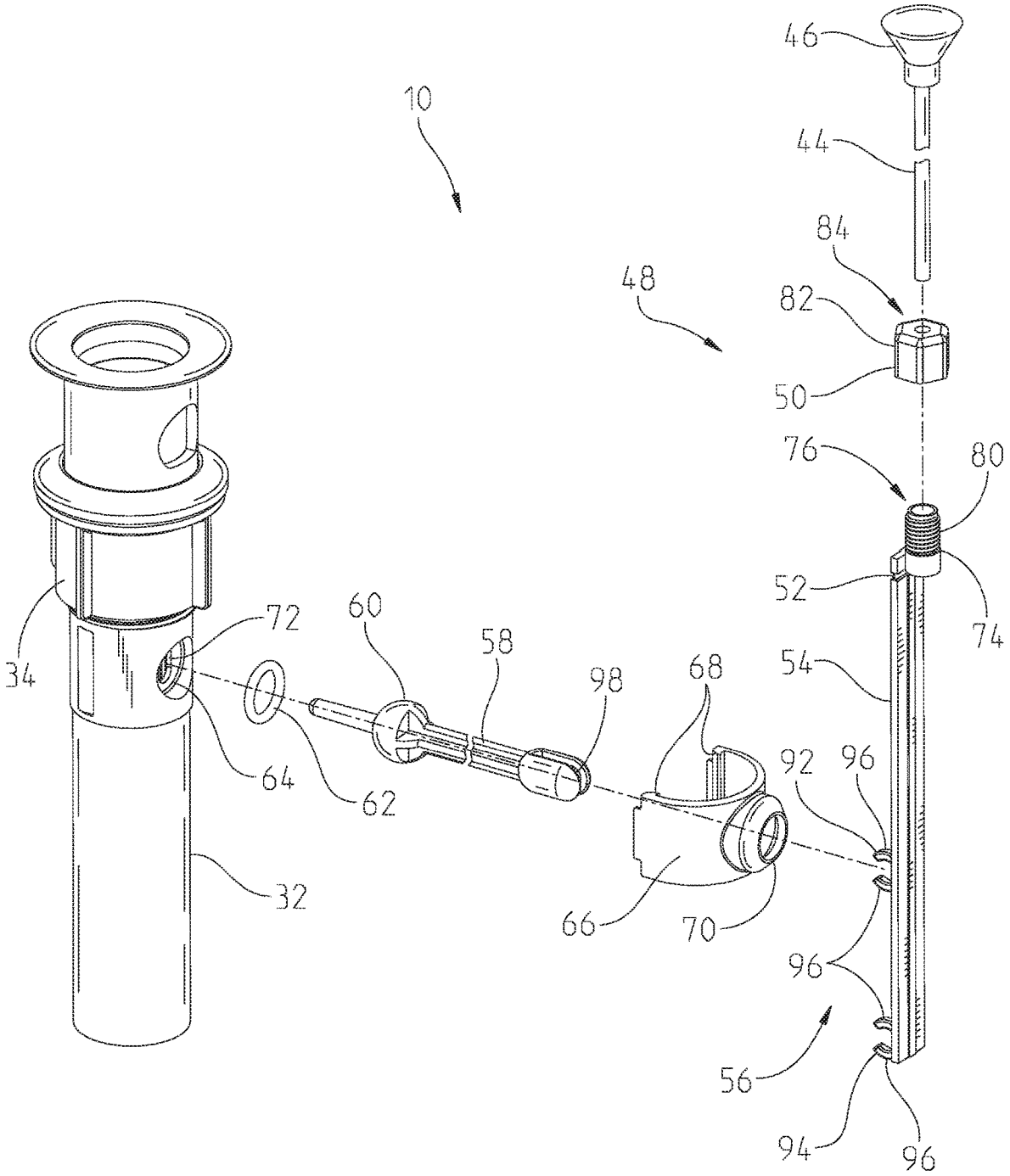
FIG. 3 is a top exploded perspective view of the drain assembly of FIG. 1; the sink basin and the drain plug of the drain assembly are omitted for clarity.

Referring now to FIGS. 2A, 2B, and 3, a lever arm 58 couples to the coupling device 48 opposite the lift rod 42. Illustratively, the lever arm 58 generally extends perpendicularly relative to the longitudinal axis 40 of the of the lift rod passageway 38. The lever arm 58 includes a pivot ball 60 that is pivotably carried by a seal 62 (illustratively, an O-ring) disposed in a recess 64 of the drain body 32. The lever arm 58 is secured to the drain body 32, and the pivot ball 60 is also pivotably carried by a collar 66. Illustratively, the collar 66 couples to the drain body 32 via snap arms 68. The lever arm 58 extends through an aperture 70 formed in the collar 66 and an aperture 72 formed in the recess 64 of the drain body 32 to couple to the drain plug 36 (see FIG. 2). Accordingly, the drain plug 36 may be actuated by actuating the lift rod 42 (more specifically, sliding the lift rod 42 along the longitudinal axis 40 relative to the upper faucet assembly 14), which moves the coupling device 48 and pivots the lever arm 58 relative to the drain body 32.

Referring specifically to FIG. 2A, the drain plug 36 may be moved to the closed position by pulling the lift rod 42 away from the sink deck 18 (generally in the direction of arrow A), which moves the coupling device 48 toward the sink deck 18 (generally in the direction of arrow B), which pivots the lever arm 58 relative to the drain body 32 (generally in the direction of arrow C), which moves the drain plug 36 inwardly relative to the drain body 32 (generally in the direction of arrow D). Conversely, the drain plug 36 may be moved to the open position by pushing the lift rod 42 toward the sink deck 18 (generally opposite the direction of arrow A), which moves the coupling device 48 away from the sink deck 18 (generally opposite the direction of arrow B), which pivots the lever arm 58 relative to the drain body 32 (generally opposite the direction of arrow C), which moves the drain plug 36 outwardly relative to the drain body 32 (generally opposite the direction of arrow D).

Figure 4:
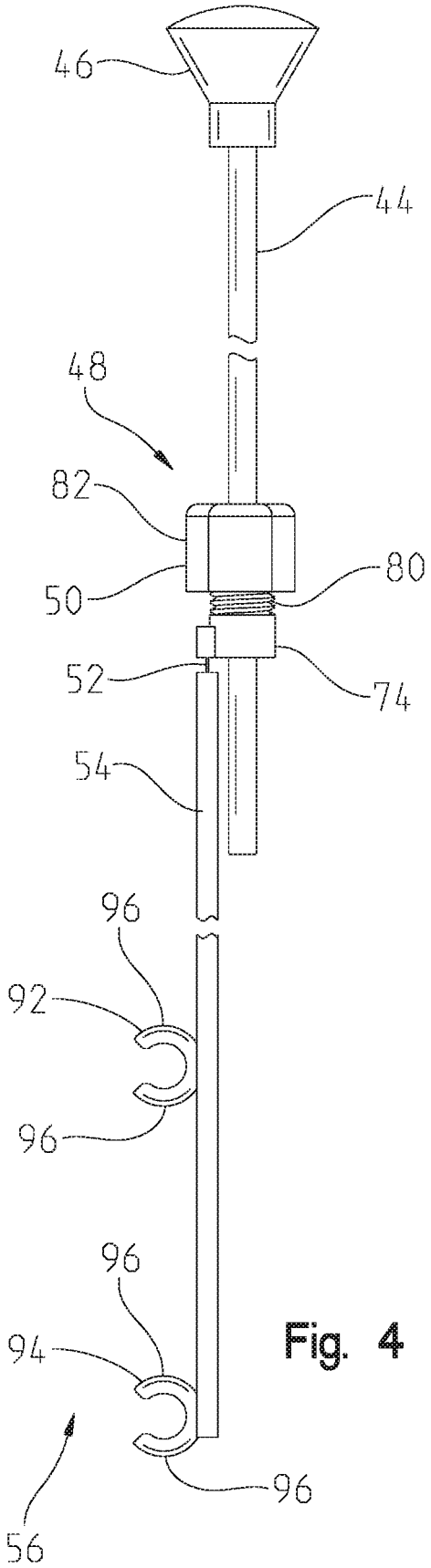
FIG. 4 is a side elevation view of the lift rod and the coupling device of the drain assembly of FIG. 1.
Figure 5:
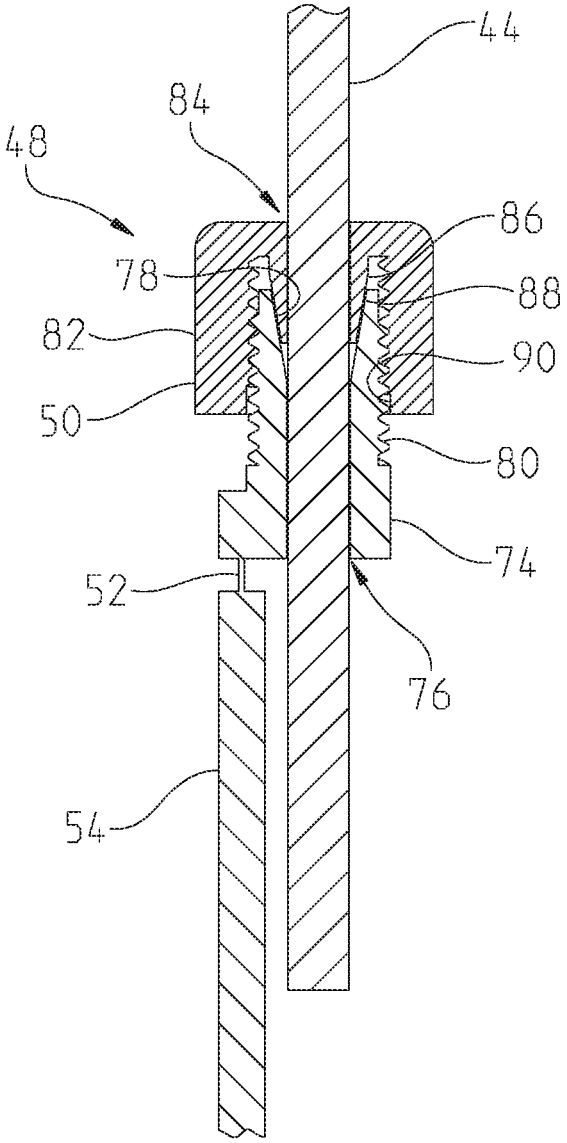
FIG. 5 is a side elevation view, in section, of portions of a lift rod and a coupling device for coupling the lift rod and a lever arm of the drain assembly of FIG. 1.

Referring now to FIGS. 3-5, the coupling device 48 and adjacent components (including, for example, the lift rod 42 and the lever arm 58) are illustrated in further detail. As described briefly above, the coupling device 48 includes a first coupling portion 50 that couples to the shaft 44 of the lift rod 42. Illustratively, the first coupling portion 50 includes a collet 74 this is disposed about the lift rod 42. Stated another way, the collet 74 includes an internal, or first, passageway 76 through which the shaft 44 of the lift rod 42 extends. The collet 74 includes a concave internal, or first, tapering surface 78 and an external, or first, threaded surface 80. The collet 74 couples to a retainer 82, which is also disposed about the shaft 44 of the lift rod 42. Stated another way, the retainer 82 includes an internal, or second passageway 84, through which the shaft 44 of the lift rod 42 extends. Illustratively, the retainer 82 is formed of a polymer, such as styrene. The retainer 82 also includes a conical portion 86, and the conical portion 86 includes the second passageway 84 and a convex external, or second, tapering surface 88. The retainer 82 further includes an internal, or second, threaded surface 90, and the second threaded surface 90 engages with the first threaded surface 80 of the collet 74 to cause the convex tapering surface 88 to engage the concave tapering surface 78 of the collet 74 to urge the conical portion 86 to engage the shaft 44 of the lift rod 42. This action secures the retainer 82 to the shaft 44 of the lift rod 42. In alternate embodiments, the first coupling portion 50 may take other forms. For example, the first coupling portion 50 may take the form of any of the coupling portions disclosed in U.S. Pat. Nos. 4,218,785 and 8,407,829, which are hereby incorporated by reference.

With continued reference to FIGS. 3-5, opposite the collet 74 couples to the living hinge 52. Generally, the living hinge 52 is a relatively thin component (in a direction substantially perpendicular to the longitudinal axis 40, as described in further detail below) that facilitates actuation of the lever arm 58 and the drain plug 36 upon actuation of the lift rod 42. More specifically, the living hinge 52 is sufficiently flexible to facilitate rotation of the leg portion 54 of the coupling device 48 and the lever arm 58 upon translation of the lift rod 42, and the living hinge 52 is also sufficiently stiff to transmit a compressive force upon pushing the lift rod 42 to move the drain plug 36 toward the open position. The living hinge 52 also permits the leg portion 54 to occupy various angles relative to the longitudinal axis 40, which in turn permits the upper faucet assembly 14 and the drain body 32 to be spaced apart by various horizontal distances, two different examples of which are illustrated in FIGS. 2A and 2B.

The living hinge 52 integrally couples to, or monolithically formed with, the leg portion 54 and/or the collet 74. Illustratively, the living hinge 52 integrally couples to both the leg portion 54 and the collet 74. In alternate embodiments, the living hinge 52 only integrally couples to one of the leg portion 54 and the collet 74, and the living hinge 52 couples to the other of the leg portion 54 and the collet 74 by other means (for example, via an adhesive or the like). Illustratively, the living hinge 52 (and the leg portion 54 and/or the collet 74) are formed of a flexible polymer, such as polypropylene, more specifically amorphous (that is, not crystalline) polypropylene. In alternate embodiments, the living hinge 52 (and the leg portion 54 and/or the collet 74) are formed of a different material.

Opposite the collet 74 the living hinge 52 couples to the leg portion 54. Generally, the leg portion 54 extends between the living hinge 52 and the second coupling portion 56. The leg portion 54 is a relatively thick component (in a direction substantially perpendicular to the longitudinal axis 40) compared to the living hinge 52. Stated another way, the living hinge 52 has a first thickness, the leg portion 54 has a second thickness, and the second thickness is greater than the first thickness. Illustratively, the second thickness is at least five times the first thickness. In some embodiments, the first thickness is about 0.012 inches (that is, 0.012±0.003 inches). The leg portion 54 is also relatively long component (in a direction substantially parallel to the longitudinal axis 40) compared to the living hinge 52. Illustratively, the leg portion 54 has a length of several inches, and the living hinge 52 has a length of about 0.080 inches (that is, 0.080±0.010 inches). In some embodiments, the living hinge 52 and the leg portion 54 have a width (that is, a dimension in the direction in and out of the page in FIGS. 4 and 5) of at least 0.5 inches.

In alternate embodiments, the leg portion 54 and the living hinge 52 could be disposed at different locations within the coupling device 48. For example, the living hinge 52 could be disposed at an intermediate position between the first coupling portion 50 and the second coupling portion 56 and divide the leg portion 54 into an upper section (not shown) and a lower section (not shown).

Opposite the living hinge 52, the leg portion 54 couples to the second coupling portion 56. Illustratively, the second coupling portion 56 includes one or more collars (for example, two collars 92, 94) including snap arms 96 for pivotably coupling to a pin 98 carried by the lever arm 58. Illustratively, the collars 92, 94 may couple to the leg portion 54 at different locations to permit the coupling device 48 to be used with drain bodies having different dimensions and/or heights. Illustratively, the collars 92, 94 integrally couple to the leg portion 54. In alternate embodiments, the second coupling portion 56 may take other forms. For example, the second coupling portion 56 may take the form of any of the coupling portions disclosed in U.S. Pat. Nos. 4,218,785 and 8,407,829.

Although the invention has been described in detail with reference to certain preferred embodiments, variations and modifications exist within the spirit and scope of the invention as described and defined in the following claims.

What is claimed is:

1. A drain assembly for a faucet, the drain assembly comprising:
- a lift rod configured to be carried by the faucet and actuated relative to the faucet; and
- a lever arm configured to actuate a drain plug;
- a coupling device comprising:
  - a first coupling portion coupled to the lift rod;
  - a second coupling portion coupled to the lever arm; and
  - a living hinge disposed between the first coupling portion and a leg portion wherein the leg portion is connected to the second coupling portion and wherein the living hinge and second connecting portion allow the leg portion to be positioned at variable angles relative to both the lift rod and the lever arm thereby facilitating actuation of the lever arm and the drain plug upon actuation of the lift rod.

2. The drain assembly of claim 1, wherein the living hinge comprises a first thickness, and the leg portion is integrally coupled to the living hinge, the leg portion having a second thickness, the second thickness being greater than the first thickness.

3. The drain assembly of claim 2, wherein the leg portion is disposed between the second coupling portion and the living hinge.

4. The drain assembly of claim 2, wherein the second thickness is at least five times the first thickness.

5. The drain assembly of claim 2, wherein the first thickness is about 0.020 inches.

6. The drain assembly of claim 2, wherein the living hinge and the leg portion comprise a flexible polymer.

7. The drain assembly of claim 6, wherein the flexible polymer comprises polypropylene.

8. The drain assembly of claim 1, wherein the first coupling portion comprises:
- a collet disposed about the lift rod, the collet comprising a concave tapering surface; and
- a retainer comprising a conical portion receiving the lift rod and including a convex tapering surface, the convex tapering surface engaging the concave tapering surface of the collet to urge the conical portion to engage the lift rod and thereby secure the retainer to the lift rod.

9. The drain assembly of claim 8, wherein the collet integrally couples to the living hinge.

10. The drain assembly of claim 8, wherein the collet further comprises a first threaded surface and the retainer further comprises a second threaded surface, the second threaded surface being engagable with the first threaded surface to cause the convex tapering surface to engage the concave tapering surface of the collet to urge the conical portion to engage the lift rod and thereby secure the retainer to the lift rod.

11. The drain assembly of claim 1, wherein the first coupling portion defines a bottom surface, the bottom surface being the surface of the coupling device which is most distant from the faucet, and wherein the lift rod extends beyond the bottom surface of the first coupling portion.

12. A drain assembly for a faucet, the drain assembly comprising:
- a lift rod configured to be carried by the faucet and actuated relative to the faucet; and
- a lever arm configured to actuate a drain plug;
- a coupling device comprising:
  - a first coupling portion coupled to the lift rod, the first coupling portion comprising:
    - a collet disposed about the lift rod, the collet comprising a concave tapering surface and a first threaded surface;
    - a retainer comprising a conical portion receiving the lift rod and including a convex tapering surface, the retainer further comprising a second threaded surface, the second threaded surface being engagable with the first threaded surface of the collet to cause the convex tapering surface to engage the concave tapering surface of the collet to urge the conical portion to engage the lift rod and thereby secure the retainer to the lift rod;
  - a second coupling portion coupled to the lever arm; and
  - a leg portion coupling the first coupling portion to the second coupling portion and facilitating actuation of the lever arm and the drain plug upon actuation of the lift rod, the leg portion being pivotal relative to the first coupling and the second coupling portion pivotally connecting the leg portion to the lever arm whereby the leg portion is positionable at variable angles relative to both the lift rod and the lever arm.

13. The drain assembly of claim 12, wherein the coupling device further comprises a living hinge integrally coupled to the leg portion.

14. The drain assembly of claim 13, wherein the living hinge is disposed between the first coupling portion and the leg portion.

15. The drain assembly of claim 12, wherein the coupling device further comprises a living hinge integrally coupled to the collet.

16. The drain assembly of claim 15, wherein the living hinge is disposed between and integrally coupled to the collet and the leg portion.

17. The drain assembly of claim 16, wherein the collet, the living hinge, and the leg portion comprise a flexible polymer.

18. The drain assembly of claim 17, wherein the flexible polymer comprises polypropylene.

19. The drain assembly of claim 12, wherein the first coupling portion defines a bottom surface, the bottom surface being the surface of the coupling device which is most distant from the faucet, and wherein the lift rod extends beyond the bottom surface of the first coupling portion.

* * * * *